United States Patent [19]

Wieland

[11] Patent Number: 5,036,556

[45] Date of Patent: Aug. 6, 1991

[54] ADJUSTABLE HEADBOARD FOR BEDS

[76] Inventor: Karl W. Wieland, 41 Brimfield Rd., Norristown, Pa. 19403

[21] Appl. No.: 486,112

[22] Filed: Feb. 28, 1990

[51] Int. Cl.[5] ..... A47C 17/00

[52] U.S. Cl. ..... 5/53.1; 5/53.2

[58] Field of Search ..... 5/53.1, 53.2, 280, 308, 5/445, 432–433

[56] References Cited

U.S. PATENT DOCUMENTS

| | | | |
|---|---|---|---|
| 2,691,175 | 10/1954 | Brahm et al. | 5/308 |
| 2,933,737 | 4/1960 | Schiffmann | 5/308 |
| 3,351,960 | 11/1967 | Burkholder | 5/432 |
| 3,419,921 | 1/1969 | Flood | 5/308 |
| 4,015,298 | 4/1977 | Scott | 5/433 |
| 4,780,919 | 11/1988 | Harrison | 5/308 X |

FOREIGN PATENT DOCUMENTS

| | | | |
|---|---|---|---|
| 2049411 | 12/1980 | United Kingdom | 5/280 |

*Primary Examiner*—Gary L. Smith
*Assistant Examiner*—Michael J. Milano

[57] ABSTRACT

A headboard arrangement comprising a vertical shell (10), a body support (12), and connecting means (50,52) for slidably and turnably connecting the body support to the shell such that the body support can be raised and tilted over a bed as a backrest, or, projected from the shell at various ascending angles as a handgrip and support (46). The shell includes spaces for bedside necessities (22).

5 Claims, 2 Drawing Sheets

ADJUSTABLE HEADBOARD FOR BEDS

FIELD OF INVENTION

This invention relates to adjustable headboards and, more particularly, to a headboard which includes an adjustable body support for reclining and, alternately, for projecting over a bed as a handgrip.

DESCRIPTION OF PRIOR ART

Many people are spending a considerable amount of time in bed watching television, reading, exercising etc., thereby creating a need for a headboard that will help to support a person in various positions in bed.

In the past, a number of adjustable headboards have been invented, but most had little acceptance, because of their complicated construction and very limited adaptability, versatility and comfort.

OBJECTS AND ADVANTAGES

An object of this invention is to provide a simply constructed headboard assembly including a shell and a body support, wherein the body support can be quickly and easily tilted over a bed at various angles for a person to recline upon.

Another object is to provide a headboard of this character in which the body support can alternately be projected from the shell over a bed as a hand grip to aid a person in movements in bed, or as a support for an oxygen tent or a mosquito net.

A further object is to provide a head board assembly which includes an easily accessible shelving arrangement for bedside necessities.

DRAWING REFERENCE NUMERALS

10—Shell
12—Body Support
14—Back Portion of 10
16—Top Portion of 10
18—Bottom Portion of 10
20—Inner Side Portions of 10
22—Shelves
24—Outer Side Portions of 10
26—Legs
28—Front Portion of 10
30—Flanges
32—Cut-Out in Top Portion
34—Cut-Out in Front Portion
36—Back Piece

38–Cushion
40—Top of 36
42—Bottom of 36
44—Sides of 36
46—Hand Grip
48—Grooves
—First Pair of Pins
52—Plurality of Pairs of Pins
54—Screeds
56—Medial Inner Portion of 10

DESCRIPTION OF THE PREFERRED EMBODYMENT

Figure 2:
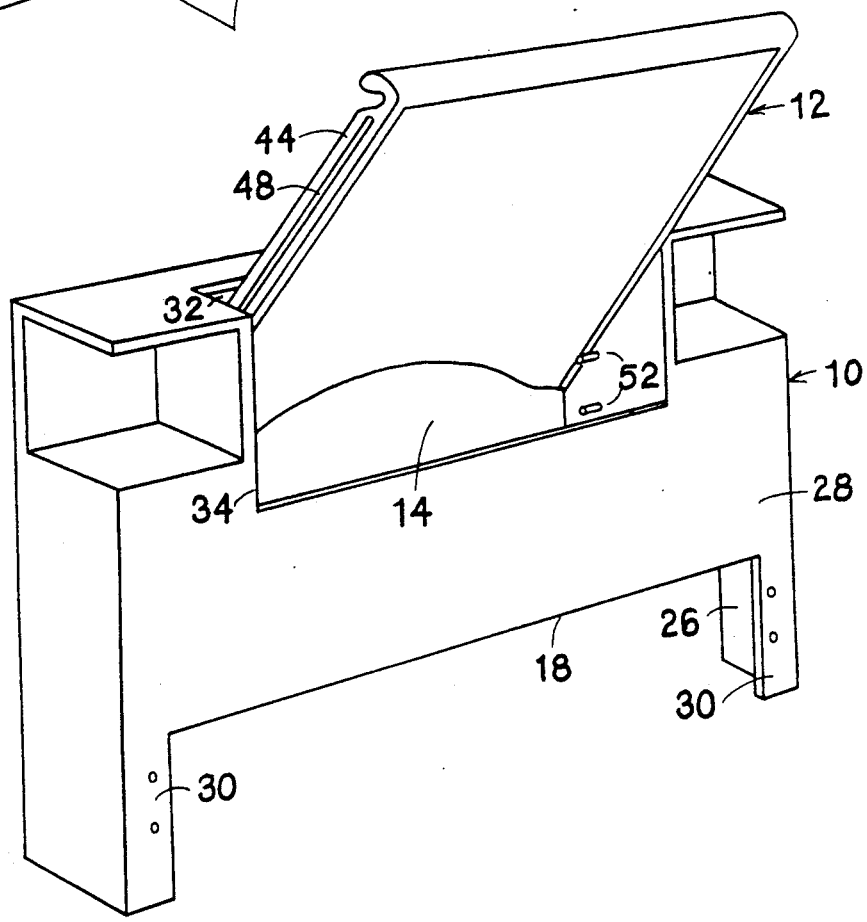
FIG. 2 is a perspective view of the adjustable headboard shown with a body support projected over a bed.
Figure 4:
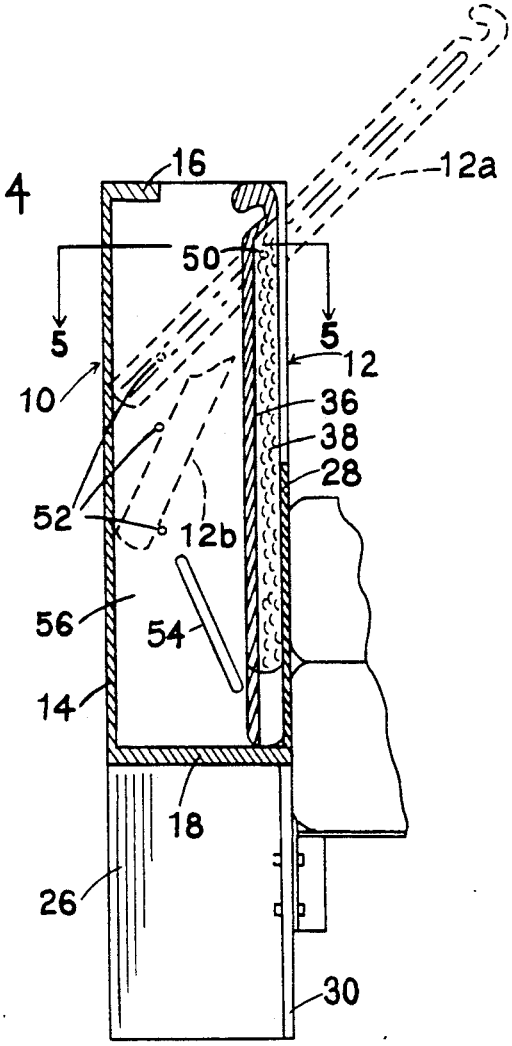
FIG. 4 is a side elevation taken on section line 4—4 of FIG. 3, illustrating the adjustable headboard with a body support in its vertical storage position (solid lines), and in a position projecting over a bed (dotted lines).
Figure 5:
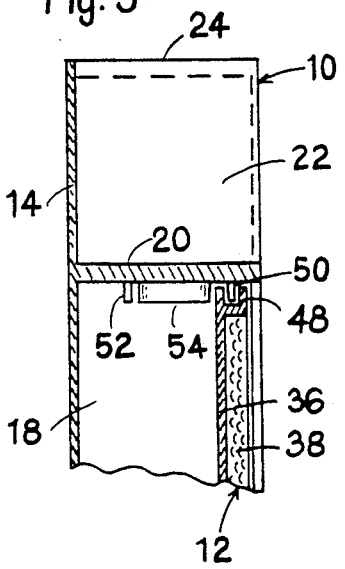
FIG. 5 is a fragmentary cross-sectional view of the adjustable headboard of this invention taken substantially along section line 5—5, of FIG. 4.

Referring to the drawings, the adjustable headboard of this invention generally comprises a shell 10 and a body support 12. Shell 10 which is preferably molded of resin, includes a rectangular back portion 14 and following portions, perpendicular to and extending forward from back portion 14, as shown in FIGS. 4, 5, . A top portion 16 and a bottom portion 18, a pair of inner side portion 20 disposed perpendicularely between top portion 16 and bottom portion 18 in a vertical parallel relation, a pair of substantially rectangular shelves 22, intermediate and parallel top portion 16 and bottom portion 18 and extending from inner side portions 20 to the vertical ends of the back portion 14, a pair of outer side portions 24 extending from the distal ends of sleeves 22 downward past bottom portion 18 to form a pair of legs 26, as seen in FIG. 4. A front portion 28, best seen in FIG. 2, extends between outer side portions 24 and between bottom portion 18 and shelves 22. Each leg 26 includes an inward facing flange 30, in forward flush alignment with legs 26, by which means shell 10 may be secured to the headend of a bed. Top portion 16 and front portion 28 include rectangular cut-outs 32 and 34 respectively, extending between inner side portions 20.

Figure 1:
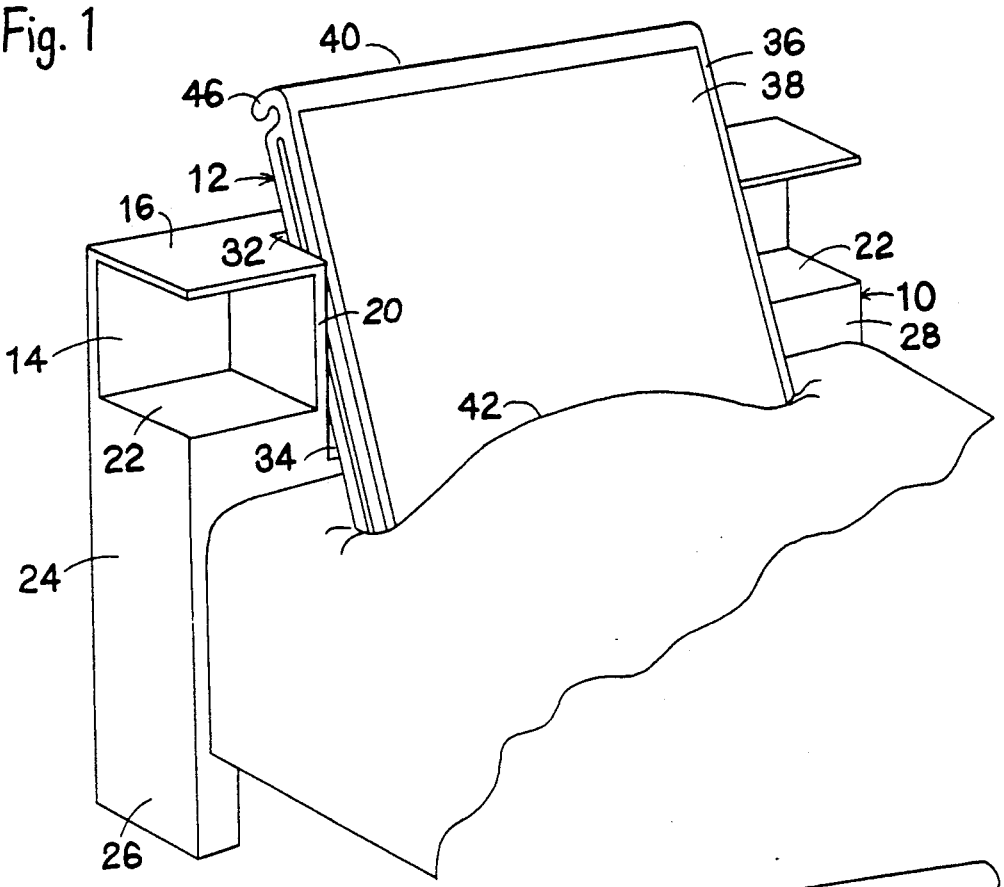
FIG. 1 is a perspective view of the adjustable headboard of this invention mounted on a bed, and shown with a body support in reclining position.

Body support 12, sized for insertion into shell 10 through cut-outs 32 and 34, consists of a substantially rectangular back piece 36 and a cushion 38. Back piece 36 is preferably molded of resin and includes a top 40, a bottom 42, and a pair of sides 44. A convoluted flange extends rearwardly from top 40 to form a hand grip 46. As best seen in FIGS. 4, 5, top 40 and sides 44 extend forward to form a seat for cushion 38, which may be held in place by cement or "Velcro Tape". As shown in FIG. 1, bottom 42 includes a medial upward curve sized to accomodate the posterior of a person sittin in bed, causing the outer portions of bottom 42 to become depressed into the surface of the bed to prevent slippage.

A pair of grooves 48, rectangular in crossection, are cut longitudionally into the outer edges of sides 44, extending from bottom 42 to a point adjacent top 40.

Figure 3:
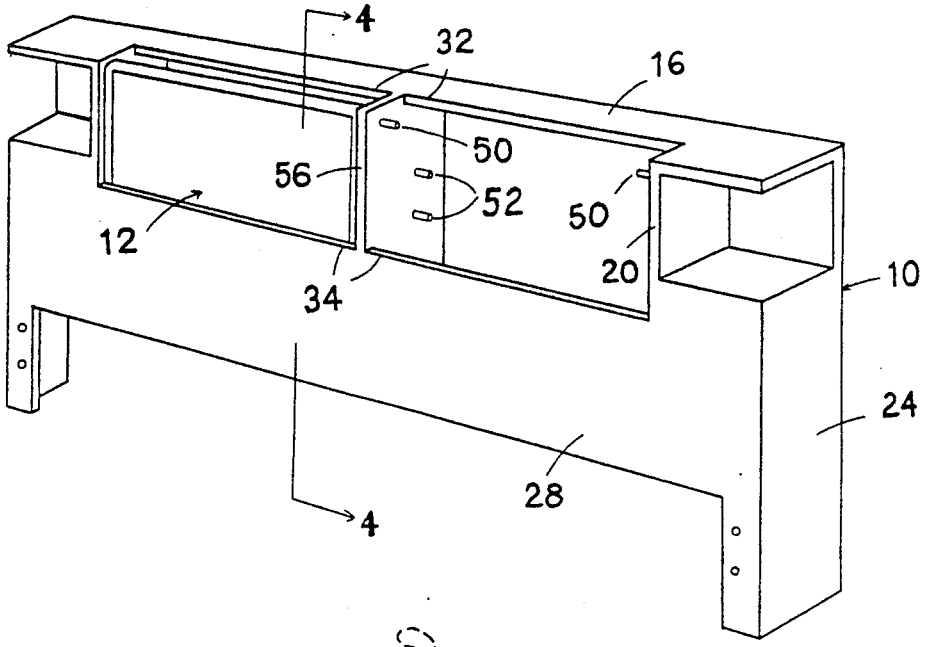
FIG. 3 is a perspective view of a variation of the adjustable headboard for use on a double bed, showing one body support in vertical storage position and one body support removed.

A first pair of opposite pins 50 are projecting from the facing sides of inner side portions 20, best seen in FIGS. 3, 4. Pins 50 are located adjacent the top edges and front edges of inner side portions 20. A plurality of pairs of opposite pins 52 are arranged in vertical alignment and spaced-apart relationship on the facing sides of inner side portions 20, adjacent back portion 14. All pins 50, 52 are in transverse horizontal alignment with respective opposite pins, and are cylindrical in shape, and of a size to permit sliding movement thereof within grooves 48, as illustrated in FIGS. 4,5. Pins 52 are spaced apart in such fashion as to permit engagement of any opposite pair there into grooves 48, and alternately permitting engagement of body support 12 betwen any adjacent opposite pairs of pins 52, with pins 50 engaged in grooves 48. See positions 12*a* and 12*b* of FIG. 4.

A pair of opposite screeds 54 are secured to the facing sides of inner side portion 20. Screeds 54 are rectangular in crossection and extent from a point adjacent bottom portion 18 and front portion 28 in rearward and upward direction to a point adjacent the lowest pair of said plurality of pairs of pins. The forward ends of screeds 54 are spaced back from front portion 28 sufficiently to permit body support 12 to slide downward on screeds 54 for insertion between front portion 28 and the forward ends of screeds 54, and to rest body support 12 on bottom portion 18 in vertical storage position.

Pins 50 remain engaged in grooves 48 at all times, except when total removel of body support 12 from shell 10 is desired.

In operation, body support 12 is grasped by handgrip 46 and raised from its vertical storage position upward above front portion 28, and tilted to a desired angle of inclination for a person to recline upon, and allowed to slide downward on pins 50, until bottom 42 rests against the surface of the bed, see FIG. 1. The horizontal edge of cut-out 30 is above the top of the bed to prevent body support 12 from sliding accidentally backward and into storage position.

Alternately, body support 12 may be adjusted to a variety of positions extending forward and upward from shell 10, by raising body support 12 over front portion 28 and lowering body support 12 in a rearward and downward direction on pins 50, for engagement of any opposite pair of pins 52 into grooves 48, until body support 12 rests against back portion 14. Hand grip 46 may now be used by a person for movements in bed, or to support an oxygen tent or mosquito net. For additional adjustments of body support 12, the lower portion thereof may be engaged between any adjacent pairs of opposite pins 52.

As illustrated in FIG. 3, a variation of the adjustable head board of this invention can be used on a double bed. In this embodyment, a section of shell 10, extending between innner side portion 20, is expanded horizontally and a medial inner portion 56 is added. A set of pins 50, 52 and screeds 54 are positioned on each side of medial inner portion 56 in transverse horizontal alignment with respective opposite pins 50, 52 and screeds 54, on the inner sides of inner side portions 20, to receive 2 separate body supports 12.

While the above description contains many specifications, these should not be construed as limitations on the scope of the invention. Other possible variations can be envisioned within its scope.

I claim as my invention:

1. An adjustable headboard for beds comprising:

a vertical shell having a substantially rectangular back portion and a pair of side portions, said side portions extending forward from the lateral edges of said back portion, means for mounting said shell to the head end of said bed, a body support having a top and a bottom and a pair of opposite parallel sides, each of said sides including an outward facing groove extending from said bottom to a point adjacent said top, said body support being proportioned to fit within said shell;

a pair of opposite pins projecting from the facing sides of said side portions adjacent the top edges and front edges thereof and being in transverse horizontal aligment about a common axis, each of said pins being cylindrical in shape and a size permitting sliding movement thereof within said grooves, and turning said body support about the common transverse horizontal axis of said pair of pins, thereby facilitating tilting said body support forwardly over the bed.

2. The adjustable headboard of claim 1 wherein said bottom of said body support is medially incurvate.

3. An adjustable headboard for beds comprising:

a vertical shell having a substantially rectangular back portion and a pair of side portions and a bottom portion, said side portions extending forward from the lateral edges of said back portion, said bottom portion extending forward from the bottom edge of said back portion, said side portions and said bottom portion being substantially perpendicular, a front portion extending between said side portions, and between said bottom portion and a line above a bed parallel with said bottom portions means for mounting said shell to the head end of said bed, a body support having a top and a bottom and a pair of opposite parallel sides, each of said sides including an outward facing groove extending from said bottom to a point adjacent said top, said body support being proportioned to fit within said shell;

a pair of opposite pins projecting from the facing sides of said side portions adjacent the top edges and front edges thereof, a plurality of pairs of opposite pins projecting from the facing sides of said side portions adjacent said back portion in vertical alignment and spaced-apart relationship, said first pair of pins and each pair of said plurality of pairs of pins being in transverse horizontal alignment, and each of said pins being cylindrical in shape and of a size permitting sliding movement thereof within said grooves and turning said body support about the common transverse horizontal axis of said first pair of pins, thereby facilitating simultaneous engagement of said first pair of pins and any pair of said plurality of pairs of pins within said grooves, a pair of opposite screeds secured to the facing sides of said side portions and extending from a point adjacent said bottom portion and said front portion in a rearward and upward direction to a point adjacent the lowest pair of said plurality of pairs of pins, the forward ends of said screeds being spaced back from said front portion sufficiently to permit vertical insertion of said body support between said front portion and the forward end of said pair of screeds.

4. The adjustable headboard of claim 3 wherein said plurality of pairs of pins are spaced apart sufficiently to permit engagement of said body support between any adjacent pairs of said plurality of pairs of pins.

5. The adjustable headboard of claim 3 wherein said body support includes means for manual gripping, connected to said top.

* * * * *